US009145788B2

(12) United States Patent
Adaickalasamy

(10) Patent No.: US 9,145,788 B2
(45) Date of Patent: Sep. 29, 2015

(54) RETROFITTABLE INTERSTAGE ANGLED SEAL

(75) Inventor: James Adaickalasamy, Bangalore (IN)

(73) Assignee: General Electric Company, Schenectady, NY (US)

( * ) Notice: Subject to any disclaimer, the term of this patent is extended or adjusted under 35 U.S.C. 154(b) by 826 days.

(21) Appl. No.: 13/356,944

(22) Filed: Jan. 24, 2012

(65) Prior Publication Data

US 2013/0189073 A1 Jul. 25, 2013

(51) Int. Cl.
*F01D 11/12* (2006.01)

(52) U.S. Cl.
CPC ..... *F01D 11/122* (2013.01); *F01D 11/125* (2013.01)

(58) Field of Classification Search
CPC ..... F01D 11/02; F01D 11/08; F01D 11/12; F01D 11/122; F01D 11/125; F01D 11/127
USPC ..... 415/173.7, 174.3, 174.4, 174.1, 174.5
See application file for complete search history.

(56) References Cited

U.S. PATENT DOCUMENTS 5,211,533 A * 5/1993 Walker et al. ..... 415/115
5,967,745 A * 10/1999 Tomita et al. ..... 415/173.7
6,152,690 A 11/2000 Tomita et al.
7,500,824 B2 3/2009 Cheng et al.
2008/0056889 A1* 3/2008 Cheng et al. ..... 415/174.4
2009/0014964 A1 1/2009 Pu et al.
2010/0254806 A1* 10/2010 Deodhar et al. ..... 415/173.7

FOREIGN PATENT DOCUMENTS

CN 101131101 2/2008
CN 101858230 10/2010

OTHER PUBLICATIONS

Office Action dated May 6, 2015 issued in corresponding Chinese Application No. 201310024397.3 (10 pages).

* cited by examiner

*Primary Examiner* — Richard Edgar
*Assistant Examiner* — Juan G Flores
(74) *Attorney, Agent, or Firm* — Nixon & Vanderhye P.C.

(57) ABSTRACT

A rotary turbomachine includes a rotor mounting at least one disk having an outer surface and at least one bucket extending radially from said outer surface. A stationary stator component is located adjacent the disk, and a seal plate extends from a portion of the stationary stator component. An angel wing seal extends from the bucket, thereby defining a clearance gap between the seal plate and the angel wing seal. An abradable seal element is disposed on the seal plate, and the abradable seal element and the seal plate are canted at an acute angle relative to a center axis of the rotor extending radially outwardly in a direction toward the angel wing seal.

20 Claims, 2 Drawing Sheets

RETROFITTABLE INTERSTAGE ANGLED SEAL

BACKGROUND OF THE INVENTION

The present invention generally relates to rotary machines such as steam and gas turbines and, more particularly, to a rotary machine seal for controlling clearance between the shank portions of rotating rotor blades or "buckets" and radially inner ends of adjacent, stationary stator components.

Land-based steam and gas turbines are used, for example, to power electric generators. Gas turbines are also used, for example, to propel aircraft and ships. A steam turbine has a steam path which typically includes in serial-flow relation, a steam inlet, a turbine, and a steam outlet. A gas turbine has a gas path which typically includes, in serial-flow relation, an air intake or inlet, a compressor, a combustor, a turbine, and a gas outlet or exhaust nozzle. In both steam and gas turbines, compressor and turbine sections include at least one circumferential row of rotating blades or buckets mounted on rotor wheels or disks. The free ends or tips of the rotating buckets are surrounded by a stator casing. The base or shank portions of the respective rotating buckets within a row are typically provided with so-called "angel-wing" seals that are flanked by stationary stator components such as nozzle vanes or diaphragms disposed, respectively, upstream and downstream of the moving blades.

The efficiency of the turbine depends in part on the radial clearance or gap between the rotor bucket angel wing seal tip(s) and a sealing structure on the adjacent stationary stator component. If the clearance is too large, excessive and valuable cooling air will leak through the gap, decreasing the turbine's efficiency. If the clearance is too small, the angel wing tip(s) will strike the sealing structure of the adjacent stator component during certain turbine operating conditions, causing undesirable wear on both the angel wing tip(s) and the stationary stator component(s).

With respect to the radial clearance mentioned above, it is known that the clearance changes during periods of acceleration or deceleration due to changing centrifugal forces on the buckets; turbine rotor vibration; and relative thermal growth between the rotating rotor and the stationary stator components. During periods of differential centrifugal force, rotor vibration, and thermal growth, the clearance changes can result in severe rubbing of the rotating bucket angel wing seal tips against the stationary seal structures. Increasing the tip-to-seal clearance gap reduces the damage due to metal to metal rubbing, but the increase in clearance results in efficiency loss.

There remains a need for a seal construction that accommodates differential axial and radial movement of the rotor/bucket assembly and the adjacent stationary stator components but that does not negatively impact turbine performance.

BRIEF SUMMARY OF THE INVENTION

In accordance with an exemplary but nonlimiting embodiment, the invention provides a rotary turbomachine comprising a rotor mounting at least one disk having an outer surface and at least one bucket extending radially from the outer surface; a stationary stator component adjacent the disk; a seal plate extending from a portion of the stationary stator component, and an angel wing seal extending from the bucket defining a clearance gap therebetween, and an abradable seal element disposed on the seal plate; wherein the abradable seal element and the seal plate are canted at an angle relative to a center axis of the rotor extending radially outwardly in a direction toward the angel wing seal.

In another aspect, the invention provides a gas turbine assembly comprising a rotor provided with a plurality of buckets disposed on a periphery of the rotor, each bucket having a shank and an airfoil, at least one axially projecting angel wing seal extending from the shank; a stationary stator component disposed adjacent to the rotor, the stationary stator component having at least one flange portion defining a seal gap with the angel wing seal; and an abradable seal disposed on a surface of the at least one flange portion, the at least one flange portion and the abradable seal oriented at an angle of between 10 and 50 degrees, relative to a center axis of the rotor.

In still another aspect, the invention provides method for reducing a seal gap at an interface between rotating and stationary components of a turbine comprising providing a rotor supporting a disk having an outer surface and at least one bucket extending radially away from the outer surface, at least one angel wing seal extending substantially axially from the at least one bucket; providing a stationary stator component axially adjacent the at least one bucket and having a discourager seal fitted with an abradable seal extending toward the angel wing seal so as to define a radial clearance gap between the angel wing seal and the abradable seal; and reducing a radial dimension of the clearance gap during axial growth of the rotor by arranging the abradable seal at an acute angel relative to a center axis of the rotor.

The invention will now be described in detail in connection with the drawings identified below.

DETAILED DESCRIPTION OF THE INVENTION

Figure 1:
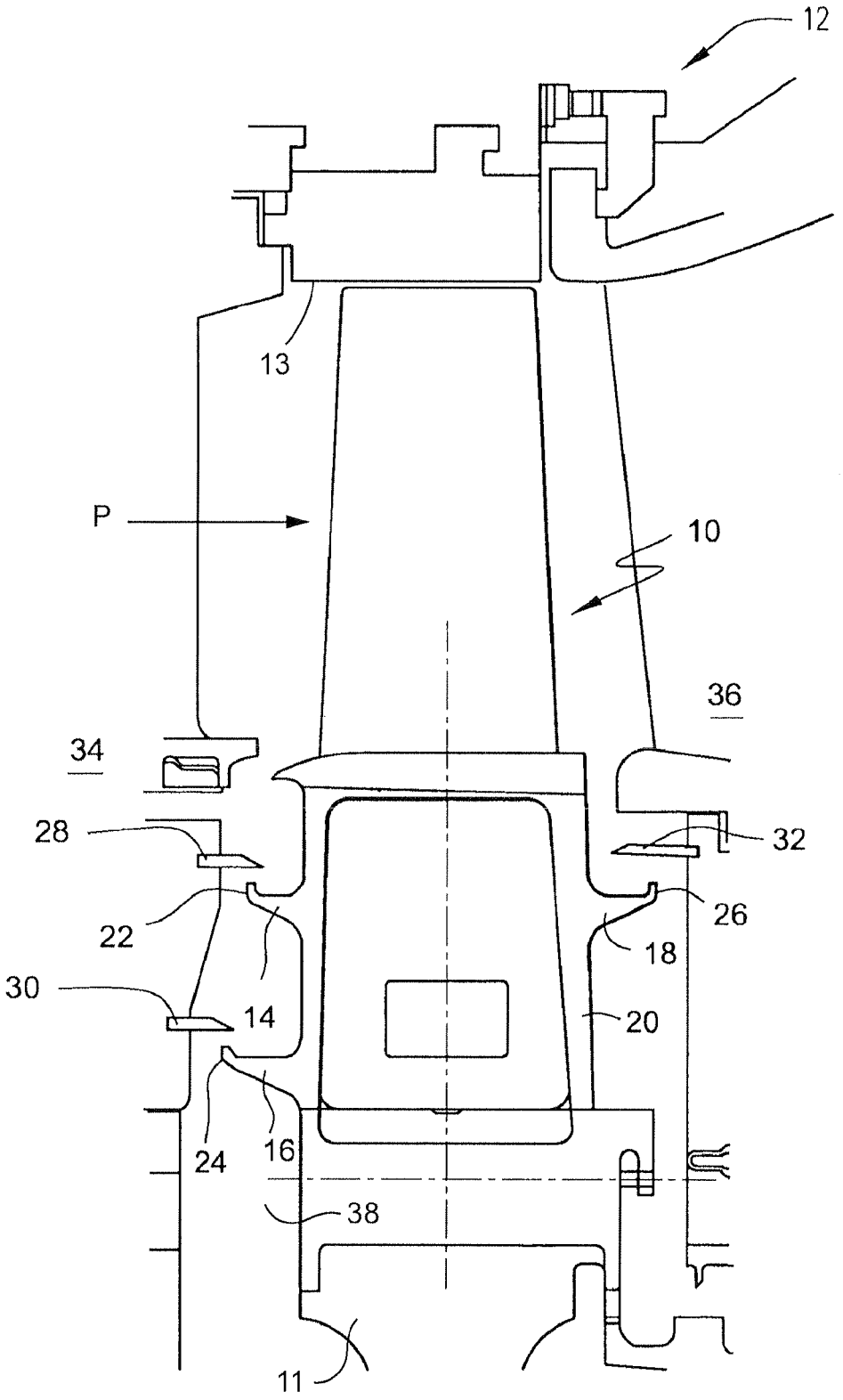
FIG. 1 (PRIOR ART)
FIG. 1 is a cross-sectional view which shows seal assemblies between a rotating bucket and stationary stator components on either side of the bucket.

FIG. 1 is a cross-sectional view which shows a conventional seal assembly for preventing or limiting cooling air from leaking from between a moving blade (or bucket) and a stationary blade (or nozzle) of a gas turbine into the high temperature combustion gas passage. The turbine of this example embodiment has a rotor or shaft (not shown in detail) rotatable about a center longitudinal axis and a plurality of blades or buckets 10 fixedly mounted on the outer annular surface of a disk 11 supported on the rotor. Typically, the buckets include a mounting portion, a shank and an airfoil. The buckets are spaced from one another circumferentially about, and extend radially outward from the outer annular surface of the rotor disk to end tips of the bucket airfoils. An outer casing 12 having a generally annular and cylindrical shape and an inner circumferential surface 13 is stationarily disposed about and spaced radially outwardly from the buckets 10 to define the axially-oriented high temperature gas path P through the turbine.

Reference numerals 14, 16, 18 denote so-called angel wing seals, which extend axially from the upstream and downstream surfaces of the shank portion 20 of the bucket 10. The angel wing seals terminate in radially outwardly extending tip(s), teeth or fins 22, 24, 26, respectively. Sealing structures or flanges 28, 30, 32, typically referred to as discourager seals, project axially from respective adjacent upstream and downstream stationary nozzle or nozzle diaphragm assemblies (or generally, stationary stator components) 34, 36 for interaction with the angel wing seal tips 22, 24, 26. These interacting seal components 22/28, 24/30, 26/32 are intended to prevent more than the necessary amount of cooling air from leaking into the high temperature combustion gas passage P from radially inner turbine wheel spaces 38.

Conventionally, the gap between, for example, the angel wing tip 22 and the discourager seal 28 is about 140 mils (3.56 mm) whereas the gap between the radially inner angel wing tip 24 and discourager seal 30 is about 125 mils (3.17 mm). Thus, the sealing performance is not always as desired. Consequently, more than a desired amount of the cooling/sealing air tends to leak into the high temperature combustion gas passage so that the amount of cooling air needed to perform the cooling function must be increased, thereby inviting deterioration in the performance of the gas turbine.

Figure 2:
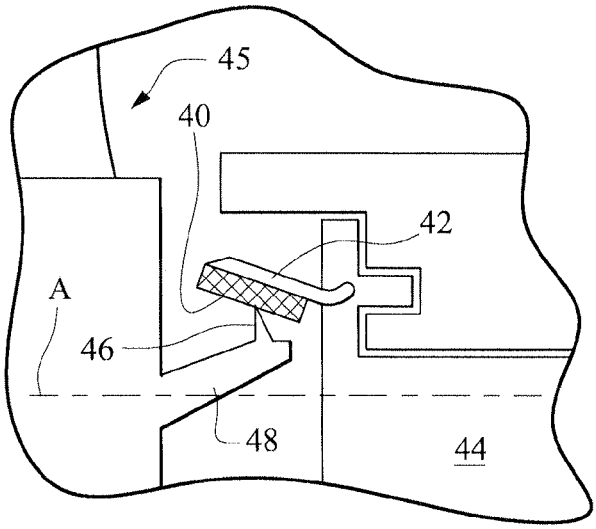
FIG. 2 is a partial cross-sectional view showing the interface between a seal on the stationary stator component and an angel wing tip of a rotating bucket in accordance with a first exemplary but nonlimiting embodiment of the invention.

Referring to FIG. 2, according to an example embodiment of the invention, an abradable seal 40, e.g. of a relatively soft material, is disposed on the radially inner surface of the discourager seal 42 of the stationary stator component 44 (downstream of the bucket 45) so as to be disposed within the annular gap defined between the inner surface of the discourager seal 42 and the end tip 46 of a canted angel wing seal 48.

As will be explained in greater detail below, during periods of differential axial and radial growth of the rotor and buckets relative to the stationary stator components, the seal member 40 abrades in response to contact therewith by the tip 46 of the respective angel wing seal 48. As such, direct contact between the moving angel wing tip 46 and the discourager seal 42 does not occur, but an acceptable, localized cavity is formed in the abradable seal material 40 applied over the seal. Although in FIG. 2 the abradable seal 40 is illustrated as being associated with (attached to) discourager seal 42, it is to be understood that such an abradable seal may, in addition or in the alternative, be provided on one or more of the radially-inner surfaces of each of the discourager seals 28, 30 and/or 32 (FIG. 1), as deemed necessary or desirable. Furthermore, although in the illustrated embodiment the angel wing seals are illustrated as terminating in tips 22, 24, 26 configured as a single tooth, it is to be understood that this is merely a schematic illustration, and the angel wing seals may also terminate two or more of axially spaced, radially-outwardly extending tips or teeth.

Note that the discourager seal (or other seal support plate, which may be in the form of a removable insert) 42 is canted in a substantially opposite radial-outward direction vis-à-vis the canted angel wing seal 48. The canted seal support plate 42 in turn, supports the similarly-canted honeycomb seal element 40, the contact face of the seal element 40 extending substantially parallel to the support plate 42. As shown in FIG. 2, the seal tip or tooth 46, formed with an angled outside edge 47 and a substantially vertical inside edge 49 (FIG. 3), is lightly engaged with the seal element 40, but this relationship varies with turbine operating conditions as described below. The seal element and seal plate are shown at about a 45° relative to the center axis of the rotor, but the angle may vary between at least about 10-50° relative to horizontal, as represented by reference line A in FIG. 2 which will be understood as extending substantially parallel to the longitudinal center axis of the turbine rotor.

Figure 3:
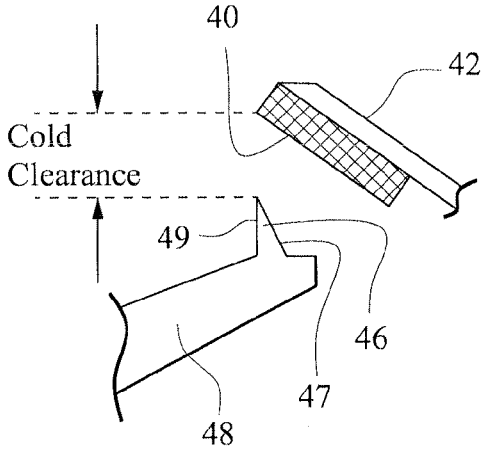
FIG. 3 is a view similar to FIG. 2, showing the gap between the angel wing tip and the stationary stator component seal in a cold condition.
Figure 4:
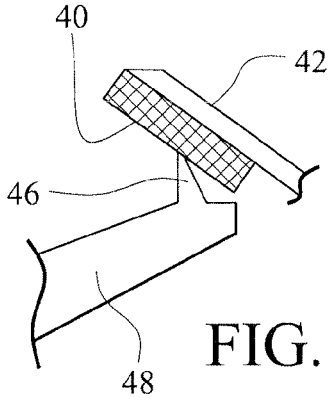
FIG. 4 is a view similar to FIG. 2, showing the gap between the angel wing tip and the stationary stator component seal in slow-speed and full-speed, full-load condition.
Figure 5:
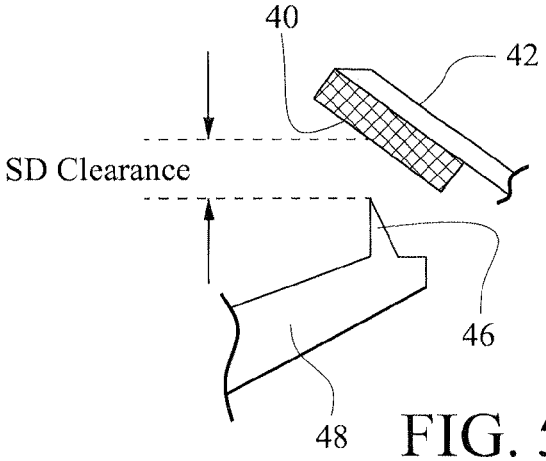
FIG. 5 is a view similar to FIGS. 3 and 4 showing the gap between the angel wing tip and the stationary stator component seal in a shutdown condition.

FIGS. 3-5 illustrate the angel wing seal tip or tooth 46 and a seal element 40 in various operating conditions of the turbine. FIG. 3 shows the seal 40 and seal 46 tooth in the cold condition. The radial clearance is quite large (e.g. 140 mils or more), and the tip or tooth 46 is located axially at the forward end of the seal 40.

FIG. 4 shows the same components in either a slow-speed condition or in a full-speed, full-load condition. Here, the seal tooth 46 has moved both axially and radially such that the seal tooth 46 penetrates the radially inner face portion of the seal element 40. For example, axial movement may be 0.400 inch or more in one axial direction and between 0.200 and 0.300 inch an opposite direction. In a steady state condition, the axial growth (to the right as viewed in FIGS. 3-5), may be between 0.100 and 0.200 inch. A maximum radial outward growth during operation may be about 0.130 inch and about 0.100 inch, steady state.

FIG. 5 shows the same components when the turbine is shut down, but note the clearance is smaller than in FIG. 3 since the engine has not fully cooled.

Thus, the angling of the seal 40 relative to the seal tip 46 narrows the radial gap when the rotor/bucket expands even if only in the axial direction, thus reducing leakage and enhancing performance.

In the presently-prepared arrangement, the seal element 40 may be an abradable coating seal, but other sealing configuration/compositions are within the skill of the art, such as a honeycomb seal, with appropriate thicknesses. For example, the honeycomb seal element 40 (and hence the discourager seal or support plate 42), in an exemplary embodiment may have a length of from about 0.5 inches to about 2.0 inches and a thickness of from about 0.150 inches to about 0.500 inches. For an abradable coating, the thickness may be in the range of 0.040 inches to 0.050 inches.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A rotary turbomachine comprising:

a rotor mounting at least one disk having an outer surface and at least one bucket extending radially from said outer surface;

a stationary stator component adjacent said disk;

a seal plate extending from a portion of said stationary stator component, wherein said seal plate is radially inwards of a platform of said stationary stator component and said seal plate extends axially out of a shank portion of said stationary stator component, and an angel wing seal extending from said bucket defining a clearance gap therebetween, an abradable seal element disposed on said seal plate, wherein said abradable seal element and said seal plate are canted in a first direction at an angle of 45° relative to a rotational axis of said rotor, extending radially outwardly in a direction toward said angel wing seal.

2. The rotary turbomachine as in claim 1, wherein said seal plate comprises a discourager seal.

3. The rotary turbomachine as in claim 1, wherein said seal plate comprises a replaceable insert selectively insertable into said stationary stator component.

4. The rotary turbomachine as in claim 1, wherein said angel wing seal comprises at least one seal tooth projecting radially outwardly from a surface of said angel wing seal.

5. The rotary turbomachine as in claim 1 wherein said abradable seal element comprises a honeycomb seal.

6. The rotary turbomachine as in claim 5 wherein said honeycomb seal has a length of between about 0.50 and 2.00 inches and a thickness of between about 0.150 and 0.500 inches.

7. The rotary turbomachine as in claim 1, wherein said abradable seal element comprises an abradable coating applied to a thickness of between about 0.040 and 0.050 inches.

8. The rotary turbomachine as in claim 1 wherein said angel wing seal is canted in a second substantially opposite direction.

9. A gas turbine assembly comprising:

a rotor having an outer perimeter and a rotational axis;

buckets disposed on the rotor and extending radially outward form the outer perimeter of the rotor, wherein the buckets form an annular row of buckets, and each of the buckets includes a shank, an airfoil radially outward of the shank, and at least one angel wing seal extending from said shank;

a stationary stator adjacent and extending around said rotor, said stationary stator including a flange defining a seal gap with said angel wing seal, said flange is radially inwards of a platform of said stationary stator, and said flange extends axially out of a shank portion of said stationary stator; and an abradable seal disposed on a surface of said flange;

wherein said at least one flange portion and said abradable seal are canted radially outwardly in a first direction at an angle of between 10 and 50 degrees, relative to the rotational axis of said rotor, and wherein said angel wing seal is canted radially outwardly in a second substantially opposite direction.

10. The gas turbine assembly as in claim 9, wherein said at least one flange portion comprises a discourager seal secured to said stationary stator component.

11. The gas turbine assembly as in claim 10, wherein said discourager seal comprises a replaceable insert selectively insertable into said stationary stator component.

12. The gas turbine as in claim 9 wherein said abradable seal element comprises a honeycomb seal.

13. The gas turbine as in claim 12 wherein said honeycomb seal has a length of between about 0.50 and 2.00 inches and a thickness of between about 0.150 and 0.500 inches.

14. The gas turbine as in claim 9, wherein said abradable seal element comprises an abradable coating applied to said surface of said flange.

15. A method for reducing a seal gap at an interface between rotating and stationary components of a turbine comprising:

providing a rotor supporting a disk having an outer surface and at least one bucket extending radially away from the outer surface, at least one angel wing seal extending substantially axially from said at least one bucket;

providing a stationary stator component axially adjacent said at least one bucket and having a discourager seal fitted with an abradable seal extending toward said angel wing seal so as to define a radial clearance gap between said angel wing seal and said abradable seal, wherein said discourager seal is radially inwards of a platform of said stationary stator component, and said discourager seal extends axially out of a shank portion of said stationary stator component; and reducing a radial dimension of said clearance gap during axial growth of said rotor by arranging said discourager seal and said abradable seal at an acute angle relative to a center axis of said rotor.

16. The method as in claim 15, wherein said acute angle is between 10 and 50 degrees relative to said center axis.

17. The method as in claim 15, wherein said abradable seal comprises a honeycomb seal.

18. The method as in claim 17, wherein said honeycomb seal has a length of between about 0.50 and 2.00 inches and a thickness of between about 0.150 and 0.500 inches.

19. The method as in claim 15, wherein said abradable seal comprises an abradable coating on said discourager seal.

20. The method as in claim 19, wherein said abradable coating is applied to a thickness of between about 0.04 and 0.05 inches.

* * * * *